US006467416B1

(12) United States Patent
Daniels et al.

(10) Patent No.: US 6,467,416 B1
(45) Date of Patent: Oct. 22, 2002

(54) COMBINED HIGH-BLAST/ANTI-ARMOR WARHEADS

(75) Inventors: Arthur S. Daniels, Rockaway, NJ (US); William J. Poulos, River Vale, NJ (US); Ernest L. Baker, Wantage, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/041,960

(22) Filed: Jan. 8, 2002

(51) Int. Cl.[7] ..... F42B 10/00
(52) U.S. Cl. ..... 102/476
(58) Field of Search ..... 102/476, 306, 102/309

(56) References Cited

U.S. PATENT DOCUMENTS

| | | | | | |
|---|---|---|---|---|---|
| 3,136,249 | A | * | 6/1964 | Poulter | 102/309 |
| 3,707,917 | A | * | 1/1973 | Zernow et al. | 102/275.4 |
| 3,906,857 | A | * | 9/1975 | Rotondi, Jr. | 102/428 |
| 4,063,512 | A | * | 12/1977 | Davis | 102/476 |
| 4,497,253 | A | * | 2/1985 | Sabranski | 102/476 |
| 4,672,896 | A | * | 6/1987 | Precoul et al. | 102/309 |
| H344 | H | * | 10/1987 | Williamsen et al. | 102/476 |
| 4,938,146 | A | * | 7/1990 | Gunther et al. | 102/430 |
| 5,123,612 | A | * | 6/1992 | Labroche et al. | 102/476 |
| 5,259,317 | A | * | 11/1993 | Lips | 102/307 |
| 5,349,908 | A | * | 9/1994 | Walz et al. | 102/307 |
| 5,353,709 | A | * | 10/1994 | Emmenegger et al. | 102/289 |
| 5,415,105 | A | * | 5/1995 | Voss et al. | 102/210 |
| H1504 | H | * | 12/1995 | Crabtree | 102/476 |
| 5,565,644 | A | * | 10/1996 | Chawla | 102/307 |
| 5,792,980 | A | * | 8/1998 | Weimann | 102/438 |
| 6,026,750 | A | * | 2/2000 | Nelson | 102/307 |
| 6,050,194 | A | * | 4/2000 | Bugiel et al. | 102/211 |
| 6,393,991 | B1 | * | 5/2002 | Funston et al. | 102/306 |

FOREIGN PATENT DOCUMENTS

| | | | |
|---|---|---|---|
| DE | 3800975 | A1 * | 7/1989 |
| JP | 04363600 | * | 12/1992 |

* cited by examiner

*Primary Examiner*—Charles T. Jordan
*Assistant Examiner*—Jordan M Lofdahl
(74) *Attorney, Agent, or Firm*—John F. Moran; Michael C. Sachs

(57) ABSTRACT

Dual mode warheads utilizing high-blast explosives (14) and a shaped charge liner (12) and a process for forming such warheads.

27 Claims, 1 Drawing Sheet

COMBINED HIGH-BLAST/ANTI-ARMOR WARHEADS

U.S. GOVERNMENT INTEREST

The inventions described herein may be manufactured, used and licensed by or for the U.S. Government for U.S. Government purposes

BACKGROUND OF THE INVENTION

1. Field of the Invention

The invention relates to high-blast, anti-armor dual mode warheads. More particularly, the invention relates to dual mode warheads utilizing high-blast explosives and a shaped charge liner and a process for forming such warheads.

2. Description of the Related Art

In typical military combat situations, it is common for soldiers to encounter circumstances where they must defeat both armor targets and bunker targets. Conventionally, these two different target types require the use of two different warhead designs. To defeat armor, it is required to use an anti-armor warhead capable of deep penetration, such as known "Javelin" or "Hellfire" munitions. Such anti-armor warheads have been known to utilize shaped charges having a metal liner driven by explosives that are designed to push the liner into the target. In general, the concept of a shaped charge involves the detonation of high explosive material in a warhead that causes a high pressure shock in the direction of the liner. This high pressure engulfs the liner, causing it to collapse and shoot out of the warhead in the form of a high-speed jet. This jet is moving at such a high speed after the blast that it is able to pierce through armor targets. Bunker defeat or wall destroying warheads primarily use blast effects as a defeat mechanism and use high-blast explosives to serve their purpose.

High-blast explosives, as compared to high explosives, contain additives that enhance the blast pressure of the expanding detonation products. There is lower initial blast pressure than high explosives, but a longer pressure pulse with larger total detonation energy. They are designed to move earth and damage structures. This extra pressure enhances the ability of devices containing high-blast explosives to move earth and destroy structural targets like bunkers, buildings and walls. In contrast, high explosives are designed to accelerate and move metal through a high initial blast pressure and a rapidly decaying detonation pulse.

Each of the two types of warheads are sufficient for their separate uses. However, while anti-armor warhead designs are effective against armor, they have relatively low blast effects compared to the high-blast warheads. Further, while high-blast explosives are very effective against bunkers or walls, they are relatively ineffective against armor. As a result, both of these separate munitions must be carried by soldiers to be prepared for any type of target. This is burdensome because carrying two sets of munitions adds great weight to be transported and also consumes a great deal of storage space. Therefore, it is desirable to have multi-purpose warheads capable of both anti-armor and high-blast functions.

The present invention provides a solution to this problem. The invention provides a single warhead utilizing a combination of shaped charge liners and high-blast explosives to enable deep penetration and high-blast against any type of target. This obviates the need to field two sets of warheads and significantly reduces logistical and weight burdens on soldiers preparing for combat.

SUMMARY OF THE INVENTION

The invention provides a high-blast, anti-armor, dual mode warhead comprising: a hollow, cylindrical outer body defining an inner cavity, said outer body having a cylindrical inner wall, a front end and a back end; the body supporting in order from the front end to the back end:

a) a hollow, shaped charge liner having a circular base and a concavity, within the inner cavity and positioned at the front end of the body, said liner having a circular base whose entire circumference is pressed against the cylindrical inner wall of the outer body and the concavity directed toward the front end of the outer body;

b) an explosive within the inner cavity filling a space between the liner and the back end of the body;

c) a solid wave shaper within the inner cavity and spaced from the liner toward the back end, the wave shaper being surrounded by explosive;

d) a precision initiation coupler within the inner cavity spaced between the wave shaper and the back end of the body, the precision initiation coupler comprising a hollow housing having a central bore, the housing being filled with an explosive around the bore and extending to the bottom of the bore; the housing being surrounded by explosive and the space between the precision initiation coupler and the wave shaper is filled with explosive; and e) a detonator assembly within the inner cavity attached to a rearward end of said coupler, said detonator assembly positioned at the back end of the body and surrounded by explosive.

The invention also provides a process for forming a high-blast, anti-armor, dual mode warhead comprising:

a) providing a hollow, cylindrical outer body defining an inner cavity, said outer body having a cylindrical inner wall, a front end, and a back end;

b) mounting a hollow, shaped charge liner having a circular base and a concavity into the inner cavity positioned at the front end of the body said liner having a circular base whose entire circumference is pressed against the cylindrical inner wall of the outer body and the concavity directed toward the front end of the outer body; and surrounding the outer surface of the liner with an explosive;

c) inserting a solid wave shaper into the explosive within the cavity rearward of the liner;

d) filling additional explosive into the inner cavity to surround the wave shaper with explosive;

e) inserting a precision initiation coupler into the additional explosive within the cavity rearward of the wave shaper, the precision initiation coupler comprising a hollow housing having a central bore, the housing being filled with an explosive around the bore and extending to the bottom of the bore; and surrounding the housing with explosive;

f) attaching a detonator assembly to the precision initiation coupler; and filling the space around the detonator, inside the cavity with explosive; and g) optionally sealing the back end of the outer body.

DETAILED DESCRIPTION OF THE PREFERRED EMBODIMENTS

The invention provides a combined high-blast, anti-armor, dual mode warhead. The warhead avoids the need for soldiers to transport separate high-blast and anti-armor munitions into combat.

Figure 1:
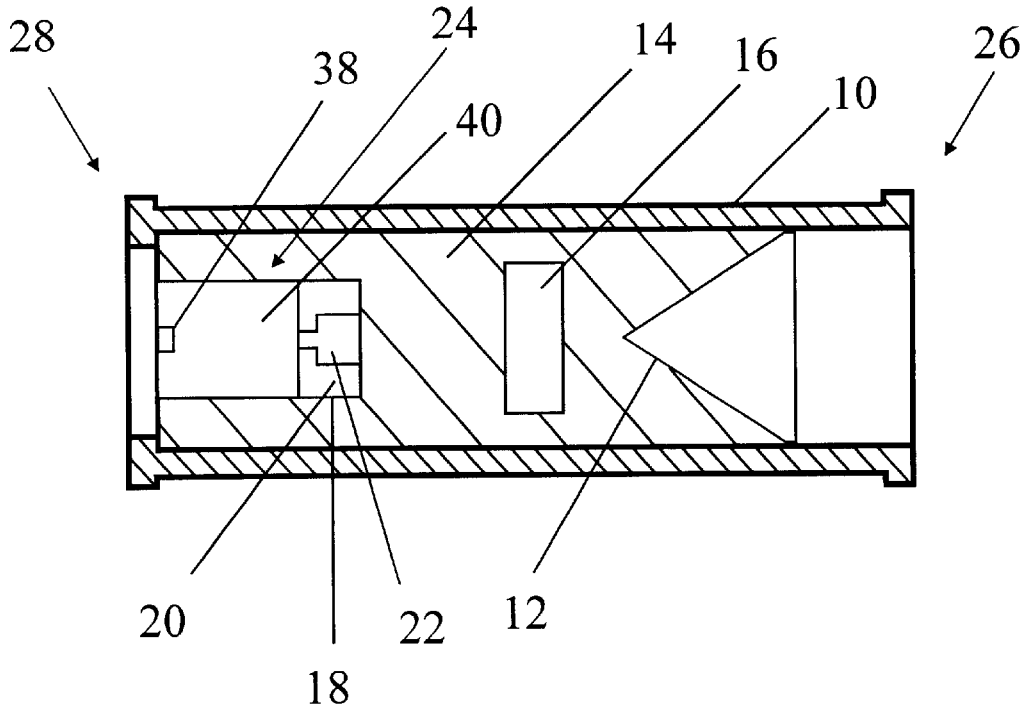
FIG. 1 illustrates a cross-sectional view of a dual-mode warhead of the invention.

As illustrated in FIG. 1, the dual mode warhead of the invention comprises a hollow, cylindrical outer body 10 defining an inner cavity, the outer body 10 having a cylindrical inner wall, a front end 26 and a back end 28. The outer body 10 is made of a metal or metal alloy and preferably comprises a metal selected from the group consisting of aluminum, copper, steel, brass, magnesium, lead, iron and combinations and alloys thereof. Of these, aluminum is the most preferred metal. The outer body may also comprise a fragmenting metallic shell as taught, for example, in U.S. Pat. No. 6,135,028 which is incorporated herein by reference.

Figure 2:
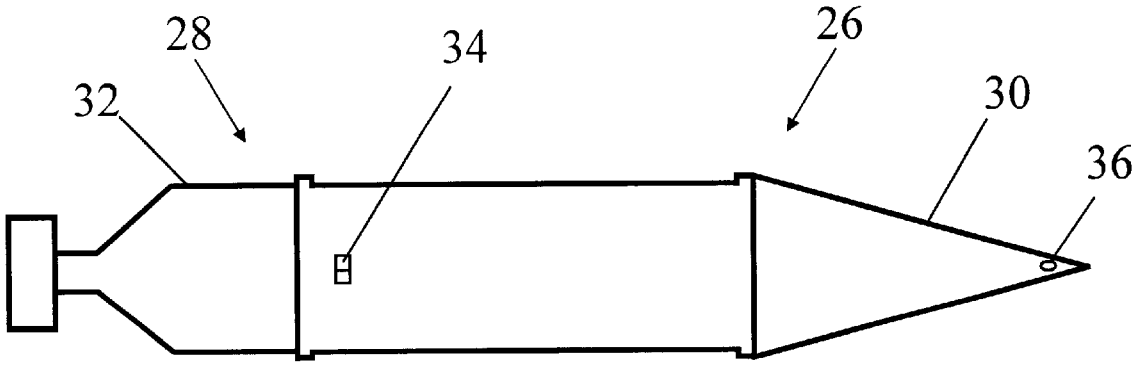
FIG. 2 illustrates a side-view of a dual-mode warhead of the invention having a nose cone attached at the front end of the warhead and a propulsion system attached at the back end.

Each of the front end 26 and back end 28 may be either open or closed when the warhead is utilized. In the preferred embodiment of the invention, the back end 28 is sealed by a propulsion system 32, as illustrated in FIG. 2, which is suitable for propelling the warhead through the air. Suitable propulsion systems include thrusters are other devices which are well known and conventionally used in the art. As also seen in FIG. 2, the front end 26 may be equipped with a nose cone 30, which are also conventionally used in the art. If included, the nose cone may be comprised of the same or a different metal as the outer body 10.

Within the inner cavity and supported by the outer body are the component parts of the warhead. In order from the front end 26 to the back end 28, the warhead comprises a hollow, shaped charge liner 12 having a circular base and a concavity. The liner preferably comprises a metal which is conical, hemispherical, trumpet shaped, compact 'Norman Helmut' shaped or variations thereof. The embodiment shown in FIG. 1 illustrates a warhead having a compact, 'Norman Helmut' shaped liner which is preferred. As seen in FIG. 1, the liner is of a sufficient size to fit within the inner cavity such that the entire circumference of the circular base is firmly pressed against the cylindrical inner wall of the body 10, and the concavity is directed toward the front end of the outer body. The liner may also be a sub-caliber of the diameter of the inner cavity. In the preferred embodiment of the invention, the inner cavity has a diameter of about 2.0 inches to about 12.0 inches, more preferably from about 2.5 inches to about 3.5 inches. The outer body preferably has a diameter of about 2.0 inches to about 12.0 inches, more preferably from about 2.5 inches to about 3.5 inches. The liner is preferably a thin layer of metal having a thickness of about 0.5 mm to about 3.5 mm, more preferably from about 1.0 mm to about 2.0 mm.

As also seen in FIG. 1, the area within the cavity surrounding the shaped charge liner 12 is filled with a high-blast explosive 14. This high-blast explosive 14 is an important component of the claimed invention and fills all of the space inside the inner cavity behind the shaped charge liner and around the other component parts of the warhead. High-blast explosives typically comprise a blend of specific chemical compounds with aluminum. Such high-blast explosives are well known in the art and their formation will not be described thoroughly herein. Useful high-blast explosives non-exclusively include trinitrotoluene, nitrocellulose, nitroglycerin, aluminum powder, magnesium powder, and gunpowder. The preferred high-blast explosives for use in the invention include the explosives named PAX 3 [64% octahydro-1,3,5,7-tetranitro-1,3,5,7-tetrazocine (HMX), 20% aluminum, 9.6% bis(2,2-dinitropropal)acetal/formal (BDNPA/F), 6.4% amorphous silicon oxide (CAB)]; Comp A3 with aluminum [63.7% hexahydro-1,3,5-trinitro-1,3,5-triazine (RDX), 30% aluminum, 6.3% wax]; HTA3 [49% HMX, 29% 2-methyl-1,3,5-trinitrobenzene (TNT), 22% aluminum]; and Hexal 70/30 [66.5% RDX, 30% aluminum, and 3.5% wax]. Of these, PAX 3 is the most preferred. The overall quantity of high-blast explosive 14 incorporated within the warhead is preferably at least about 3.0 lbs, more preferably at least about 2.5 lbs.

Within the inner cavity and spaced from the shaped liner 12 toward the back end of the cavity is a solid wave shaper 16. Wave shaper 16 is preferably positioned parallel to the central vertical axis of the outer body 10 and is preferably rectangular or cylindrical in shape having a circumference less than that of the inner cavity, as illustrated in FIG. 1. The wave shaper 16 may also comprise other shapes suitable within the scope of the invention. The wave shaper 16 preferably comprises a material selected from the group consisting of aluminum, copper, steel, brass, lead, iron, plastic and combinations thereof. Of these, copper is the most preferred. It is also preferred that the wave shaper 16 is completely surrounded by high-blast explosive 14, as illustrated in FIG. 1.

Spaced from the wave shaper and also preferably positioned parallel to the central axis of the outer body is a precision initiation coupler 18. The precision initiation coupler comprises a hollow housing 20 having a central bore. The housing is preferably filled with a high explosive 22 around the bore and extending through to the bottom of the bore. Any high explosive may be used herein as known in the art. In the preferred embodiment of the invention, the high explosive comprises PBXN-5. PBXN-5 is a mixture comprising 95% HMX and 5% vinylidene fluoride/hexafluoropropylene copolymer (VITON A). Surrounding the precision initiation coupler 18 and filling the space between the precision initiation coupler 18 and the wave shaper 16 is high-blast explosive 14. One main difference between the compositions of high explosive 22 and the high-blast explosive 14 of the invention is that the high explosive does not contain aluminum. In the preferred embodiment of the invention, the housing 20 of the precision initiation coupler 18 is cylindrical in shape, however any other shape coupler may be used as is suitable within the scope of the invention. Further, the housing 20 preferably comprises a material selected from the group consisting of aluminum, copper, steel, brass, lead, iron, plastic and combinations thereof. Of these, aluminum is preferred.

Attached to the rearward end of the coupler 18 at the back end of the body within the inner cavity is a detonator assembly 24. The detonator assembly 24 comprises a detonator 40 connected to a fuse 38, the fuse 38 being capable of actuating the detonator 40. As seen in FIG. 1, the detonator assembly 24 is preferably completely surrounded by high-blast explosive 14.

Connected to the outer body 10 at the front end 26 or on the nose cone 30 (if included) is a sensor 36, as can be seen in FIG. 2. The sensor 36 is electrically connected to the fuse 38 such that upon impact with a target the sensor 36 transmits a signal to the fuse 38 to set off the detonator 40 and ignite the warhead. The sensor 36 is also electrically connected to a switch 34 that is capable of alternately switching the operation of the warhead between anti-armor and high-blast modes. The switch 34 is preferably located near the back end 28 of the outer body 10 and may be a simple switch capable of being manually manipulated by a user or may be capable of detecting the proper mode automatically by an appropriate sensor and switch arrangement. When the switch 34 is set in anti-armor mode, the sensor 36 will immediately transmit a signal to the fuse 38 to ignite the warhead. When the switch 34 is set in high-blast mode, the sensor 36 will transmit a signal to the fuse 38. In the most preferred embodiment of the invention, when in anti-armor mode, the sensor 36 is capable of triggering the detonator 40 when impacting the desired target. This is particularly preferred for shaped charge warheads because the effectiveness against armor targets is increased when the warhead explodes just prior to impact.

The warhead is preferably formed by conducting the following steps. First, a high-blast explosive comprising either one or a combination of the aforementioned preferred high-blast explosives is formed following techniques conventionally known in the art. After the high-blast explosive is formed, it is compacted into a cylindrical shape around the shaped charge liner forming an explosive billet/liner assembly using techniques conventionally know in the art.

Next, a cavity is machined into the back of the billet/liner assembly. Subsequently, the wave shaper is inserted into the cavity. Depending on the quantity of high-blast explosive initially packed into the shell, a portion of the high-blast explosive may have to be removed to open a pocket for insertion of the wave shaper. This may be done using any suitable means, such as with a lathe, a drill or with manually operated tools. The wave shaper is then inserted into that pocket. After the wave shaper is inserted, a previously compacted cylindrical explosive billet is firmly attached to the back end of the billet/liner assembly using a conventional adhesive material and the wave shaper is fully enclosed in explosive.

Next, a cavity is machined into the back of the explosive and the precision initiation coupler is inserted. It is preferred that the central bore of the precision initiation coupler is positioned at the central axis of the warhead. This will facilitate the centering of a detonation wave through the warhead after ignition of the explosive within the aluminum housing. The aluminum housing of the coupler is pre-filled with high explosive prior to insertion into the inner cavity, It may also be necessary to remove a portion of high-blast explosive to open a space for insertion of the coupler. Next, a previously compacted explosive billet is machined into a hollow cylinder with an inside diameter with sufficient clearance for the precision initiation coupler and detonator assembly. It is then attached to the back of the explosive billet/wave shaper/liner assembly using adhesive material. This assembly is machined to the appropriate length and diameter to fit into the warhead body. The overall quantity of high blast explosive contained within the body is from about 2.5 lbs. to about 10 lbs. of explosive, more preferably from about 2.5 lbs. to about 5 lbs. of explosive. It should be known that this process is not intended to be strictly limiting to the formation of the claimed dual-mode warhead and that the process may vary as necessary to produce a dual-mode warhead as claimed and as illustrated in the figures.

In use, the dual-mode warhead of the invention is capable of being fired from an appropriate vessel or from a shoulder launching propulsion system, such as the AT4. After impact with the target, the sensor will trigger the fuse either immediately or after a short delay, depending on whether the warhead is set to anti-armor or high-blast mode. Upon initiation, the fuse will set off the detonator, which will detonate the high explosive within the precision initiation coupler housing.

After the high explosive in the precision initiation coupler detonates, the high-blast explosive between the coupler and the wave shaper is ignited, creating a detonation wave which traverses through the warhead. This detonation wave then continues through the high-blast explosive through to the wave shaper. The wave shaper then acts as a shock wave barrier in the center of the warhead while the detonation wave proceeds unimpeded in the areas not blocked by the wave shaper. This only momentarily delays the shock wave as the wave shaper soon burns up. However, the delay is sufficient to deform the shock wave, causing the unimpeded portions to progress through to the high-blast explosive surrounding the edges of the liner. This intense pressure around the liner causes the liner to implode and as the shock wave continues to move forward, and the liner collapses causing a high speed jet to emerge sufficient to pierce a significant amount of armor.

What is claimed is:

1. A high-blast, anti-armor, dual mode warhead comprising:

a hollow, cylindrical outer body defining an inner cavity, said outer body having a cylindrical inner wall, a front end and a back end; the body supporting in order from the front end to the back end:

a) a hollow, shaped charge liner having a circular base and a concavity, within the inner cavity and positioned at the front end of the body, said liner having a circular base whose entire circumference is pressed against the cylindrical inner wall of the outer body and the concavity directed toward the front end of the outer body;

b) an explosive within the inner cavity filling a space between the liner and the back end of the body;

c) a solid wave shaper within the inner cavity and spaced from the liner toward the back end, the wave shaper being surrounded by explosive;

d) a precision initiation coupler within the inner cavity spaced between the wave shaper and the back end of the body, the precision initiation coupler comprising a hollow housing having a central bore, the housing being filled with an explosive around the bore and extending to the bottom of the bore; the housing being surrounded by explosive and the space between the precision initiation coupler and the wave shaper is filled with explosive; and e) a detonator assembly within the inner cavity attached to a rearward end of said coupler, said detonator assembly positioned at the back end of the body and surrounded by explosive.

2. The dual mode warhead of claim 1 wherein the outer body comprises a metal selected from the group consisting of aluminum, copper, steel, brass, magnesium, lead, iron and combinations and alloys thereof.

3. The dual mode warhead of claim 1 further comprising a nose cone attached to the front end of the body.

4. The dual mode warhead of claim 1 wherein the back end of the body is open.

5. The dual mode warhead of claim 1 further comprising a propulsion system attached to the back end of the body.

6. The dual mode warhead of claim 1 wherein said detonator assembly comprises a detonator connected to a fuse.

7. The dual mode warhead of claim 3 further comprising a sensor device attached to the nose cone, said sensor device being electrically connected to said detonator assembly and capable of triggering the detonator assembly.

8. The dual mode warhead of claim 1 wherein the explosive comprises a material selected from the group consisting trinitrotoluene, nitrocellulose, nitroglycerin, aluminum powder, magnesium powder, octahydro-1,3,5,7-tetranitro-1,3,5,7-tetrazocine, bis(2,2-dinitropropal)acetal/formal, amorphous silicon oxide,; hexahydro-1,3,5-trinitro-1,3,5-triazine, 2-methyl-1,3,5-trinitrobenzene and gunpowder.

9. The dual mode warhead of claim 1 wherein the diameter of the outer body is from about 2.0 inches to about 12.0 inches in diameter.

10. The dual mode warhead of claim 1 further comprising a switch electrically connected to the detonator assembly for alternately switching the operation of the warhead between anti-armor and high-blast modes.

11. The dual mode warhead of claim 1 wherein the shaped charge liner comprises a thin layer of material selected from the group consisting of glass, ceramic, aluminum, copper, steel, brass, lead, iron and combinations thereof.

12. The dual mode warhead of claim 1 wherein the liner is hemispherical in shape.

13. The dual mode warhead of claim 1 wherein the liner is conical in shape.

14. The dual mode warhead of claim 1 wherein the liner is trumpet shaped.

15. The dual mode warhead of claim 1 wherein the liner is a compact Norman Helmut shape.

16. The dual mode warhead of claim 1 wherein the liner is from about 0.5 mm to about 3.5 mm in thickness.

17. The dual mode warhead of claim 1 wherein the wave shaper comprises a material selected from the group consisting of aluminum, copper, steel, brass, lead, iron, plastic and combinations thereof.

18. The dual mode warhead of claim 1 wherein the wave shaper is rectangular or cylindrical in shape.

19. The dual mode warhead of claim 1 wherein the precision initiation coupler is cylindrical in shape.

20. The dual mode warhead of claim 1 wherein the precision initiation coupler housing comprises a material selected from the group consisting of aluminum, copper, steel, brass, lead, iron, plastic and combinations thereof.

21. A process for forming a high-blast, anti-armor, dual mode warhead comprising:

a) providing a hollow, cylindrical outer body defining an inner cavity, said outer body having a cylindrical inner wall, a front end, and a back end;

b) mounting a hollow, shaped charge liner having a circular base and a concavity into the inner cavity positioned at the front end of the body, said liner having a circular base whose entire circumference is pressed against the cylindrical inner wall of the outer body and the concavity directed toward the front end of the outer body; and surrounding the outer surface of the liner with an explosive;

c) inserting a solid wave shaper into the explosive within the cavity rearward of the liner;

d) filling additional explosive into the inner cavity to surround the wave shaper with explosive;

e) inserting a precision initiation coupler into the additional explosive within the cavity rearward of the wave shaper, the precision initiation coupler comprising a hollow housing having a central bore, the housing being filled with an explosive around the bore and extending to the bottom of the bore; and surrounding the housing with explosive;

f) attaching a detonator assembly to the precision initiation coupler; and filling the space around the detonator assembly inside the cavity with explosive; and g) optionally sealing the back end of the outer body.

22. The process of claim 21 wherein said explosive comprises a material selected from the group consisting trinitrotoluene, nitrocellulose, nitroglycerin, aluminum powder, magnesium powder, octahydro-1,3,5,7-tetranitro-1,3,5,7-tetrazocine, bis(2,2-dinitropropal)acetal/formal, amorphous silicon oxide,; hexahydro-1,3,5-trinitro-1,3,5-triazine, 2-methyl-1,3,5-trinitrobenzene and gunpowder.

23. The process of claim 21 wherein said detonator assembly comprises a detonator connected to a fuse.

24. The process of claim 21 further comprising attaching a propulsion system to the back end of the housing.

25. The process of claim 21 further comprising electrically connecting a switch to the warhead, said switch capable of alternately switching the warhead between anti-armor and high-blast modes.

26. The process of claim 21 further comprising attaching a nose cone to the front end of the body.

27. The process of claim 26 further comprising attaching a sensor device to the nose cone and electrically connecting the sensor device to the detonator assembly, wherein said sensor is capable of detonating the detonator assembly.

* * * * *